US010163619B2

(12) United States Patent
Brown

(10) Patent No.: US 10,163,619 B2
(45) Date of Patent: Dec. 25, 2018

(54) IDENTIFICATION AND REMOVAL OF CHEMICAL NOISE FOR IMPROVED MS AND MS/MS ANALYSIS

(71) Applicant: MICROMASS UK LIMITED, Wilmslow (GB)

(72) Inventor: Jeffery Mark Brown, Hyde (GB)

(73) Assignee: MICROMASS UK LIMITED, Wilmslow (GB)

( * ) Notice: Subject to any disclaimer, the term of this patent is extended or adjusted under 35 U.S.C. 154(b) by 59 days.

(21) Appl. No.: 15/305,490

(22) PCT Filed: Apr. 21, 2015

(86) PCT No.: PCT/GB2015/051182
§ 371 (c)(1),
(2) Date: Oct. 20, 2016

(87) PCT Pub. No.: WO2015/162415
PCT Pub. Date: Oct. 29, 2015

(65) Prior Publication Data

US 2017/0062199 A1 Mar. 2, 2017

(30) Foreign Application Priority Data

Apr. 23, 2014 (EP) ..... 14165560
Apr. 23, 2014 (GB) ..... 1407116.1

(51) Int. Cl.
*H01J 49/42* (2006.01)
*H01J 49/00* (2006.01)

(52) U.S. Cl.
CPC ..... *H01J 49/426* (2013.01); *H01J 49/004* (2013.01); *H01J 49/0027* (2013.01); *H01J 49/0036* (2013.01); *H01J 49/4215* (2013.01)

(58) Field of Classification Search
None
See application file for complete search history.

(56) References Cited

U.S. PATENT DOCUMENTS 5,635,713 A * 6/1997 Labowsky ..... H01J 49/0027 250/282
6,747,272 B2 6/2004 Takahashi
7,339,163 B2 3/2008 Marriott
8,237,106 B2 8/2012 Castro-Perez et al.
9,075,782 B2 7/2015 Morinaga
(Continued)

OTHER PUBLICATIONS

Igor V. Chernushevich et al., "An Introduction to Quadrupole-Time-of-Flight Mass Spectrometry", Journal of Mass Spectrometry, vol. 36, No. 8, p. 849-865, Aug. 2001.
(Continued)

*Primary Examiner* — Andrew Smyth
(74) *Attorney, Agent, or Firm* — Womble Bond Dickinson (US) LLP; Deborah M. Vernon; Heath T. Misley

(57) ABSTRACT

A method of mass spectrometry is disclosed comprising mass analyzing ions and obtaining mass spectral data and determining parent or precursor ions of interest. The method further comprises determining first adduct or chemical artifact ions which have mass to charge ratios which have a substantially linear relationship with the mass to charge ratio of the parent or precursor ions of interest and removing or attenuating the first adduct or chemical artifact ions from the mass spectral data.

17 Claims, 2 Drawing Sheets

(56) References Cited

U.S. PATENT DOCUMENTS

| | | | | |
|---|---|---|---|---|
| 9,328,335 | B2 * | 5/2016 | Durrett | C12N 9/1029 |
| 2005/0176074 | A1 * | 8/2005 | Dick | C12Q 1/26<br>435/7.23 |
| 2007/0228268 | A1 * | 10/2007 | Marriott | H01J 49/0045<br>250/282 |
| 2008/0149824 | A1 * | 6/2008 | Miller | G01N 27/624<br>250/287 |
| 2009/0029473 | A1 * | 1/2009 | Han | G01N 33/6896<br>436/13 |
| 2009/0194688 | A1 * | 8/2009 | Bateman | H01J 49/4215<br>250/292 |
| 2009/0302210 | A1 * | 12/2009 | Castro-Perez | H01J 49/0031<br>250/282 |
| 2012/0303288 | A1 * | 11/2012 | Morinaga | G06F 19/24<br>702/23 |
| 2013/0116462 | A1 * | 5/2013 | Durrett | C12N 9/1029<br>554/227 |
| 2015/0034815 | A1 * | 2/2015 | Bonner | H01J 49/0027<br>250/282 |

OTHER PUBLICATIONS

Baumann H I et al., "Inter-Annual Stability of Oligopeptide Patterns of Planktothrix Rubescens Blooms and Mass Mortality of Daphnia in Lake Hallwilersee", Limnologica, Elsevier, NL, vol. 38, No. 3-4, p. 350-359, Oct. 2008.

Ghislain Cheguillaume et al., "Characterization of Peptides by Liquid Chromatography/Electrospray Ionization Mass Spectrometry Using Silver Nitrate as a Post-Column Complexant", Journal of Mass Spectrometry, vol. 39, No. 4, p. 368-377, Apr. 2004.

* cited by examiner

A = unknown adducts (mw)
B = Bradykinin (mw)

y1 = 2 x – B;
2+ ions selected
$\{(A + H)(B + H)^{2+}\}$ cluster – loses
(B + H) 1+leaving $(A + H)^{+}$ ions at y1 y2 = 1.5x-B/2;
3+ ions selected =
$\{(A + 2H)^{2-}(B + H)^{+}\}$ cluster loses
$(B + H)^{+}$ leaving $(A + 2H)^{2+}$ ions at y2 y3 = 2x-B/2;
4+ ions selected =
$\{(A + 2H)^{2+}(B + 2H)^{2+}\}$ cluster
loses $(B + 2)^{2+}$ leaving
$(A + 2H)^{2+}$ ions at y3 y4 = 3x-B;
3+ ions selected =
$\{(A + H)^{+}(B + 2H)^{2+}\}$ cluster
loses $(B + 2)^{2+}$ leaving
$(A + H)^{1+}$ ions at y4 also
B2+
$(B+A+2H)^{2+}$ loss/gain of neutral A

B1+
$(B+A)^{+}$ loss/gain of neutral A

FIG. 1B

IDENTIFICATION AND REMOVAL OF CHEMICAL NOISE FOR IMPROVED MS AND MS/MS ANALYSIS

CROSS-REFERENCE TO RELATED APPLICATIONS

This application represents the U.S. National Phase of International Application No. PCT/GB2015/051182 entitled "Identification and Removal of Chemical Noise for Improved MS and MS/MS Analysis" filed 21 Apr. 2015, which claims priority from and the benefit of United Kingdom patent application No. 1407116.1 filed on 23 Apr. 2014 and European patent application No. 14165560.5 filed on 23 Apr. 2014. The entire content of these applications are incorporated herein by reference.

FIELD OF THE INVENTION

The present invention relates generally to mass spectrometry and in particular to methods of mass spectrometry and mass spectrometers.

BACKGROUND

In proteomics and other similar types of experiments chemical noise or background ions (often of unknown origin) can inadvertently be counted or treated as analyte data and can cause lower scores or even false positive identifications when library searching from either MS and/or MS/MS data.

Some of the chemical "noise" comprises multiply charged clusters adducted to the analyte peptides. Multiply charged parent or precursor adduct ions may be present as well as fragment ions from such clusters. The cluster adduct ions may originate from solvents.

US 2012/303288 (Morinaga) discloses a data analysis method in which clustering is performed on standardised intensity values peaks such that isotope peak groups and adduct ion peaks derived from the same substance but having different mass to charge ratios values are placed together in the same clusters. Clusters that are considered redundant are removed.

It is desired to provide an improved method of mass spectrometry.

SUMMARY

According to an aspect there is provided a method of mass spectrometry comprising:

mass analysing ions and obtaining mass spectral data;

determining parent or precursor ions of interest;

determining first adduct or chemical artefact ions which have mass to charge ratios which have a substantially linear relationship with the mass to charge ratio of the parent or precursor ions of interest; and removing or attenuating the first adduct or chemical artefact ions from the mass spectral data.

According to an embodiment a parent ion ("MS") or daughter ion ("MS/MS") mass spectrum may be recorded or obtained and a list of parent or precursor ions may be identified. A list of noise peaks may then be calculated or otherwise determined from the list of parent or precursor ions according to predetermined relationships, for example substantially linear relationships, between the parent or precursor ions and predicted noise peaks due, for example, to adduct ions. The noise peaks (e.g. adduct ions) may then be removed from the mass spectral data in order to improve the specificity of MS/MS data.

The embodiment is concerned with improved methods of removing chemical noise from mass spectral data.

The embodiment differs from the arrangement disclosed in US 2012/303288 (Morinaga) in that adduct or chemical artefact ions are identified based on a substantially linear relationship between the mass to charge ratios of the adduct or chemical artefact ions and the mass to charge ratio of the parent or precursor ions or interest.

The method may further comprise progressively scanning a mass to charge ratio transmission window of a mass filter.

The mass filter may comprise a quadrupole rod set mass filter.

The method may further comprise causing the mass filter to onwardly transmit the parent or precursor ions of interest and to attenuate or filter other parent or precursor ions.

The method may further comprise subjecting the parent or precursor ions of interest to fragmentation or reaction so as to generate fragment or product ions.

The first adduct or chemical artefact ions may have a non-random mass to charge ratio distribution.

The first adduct or chemical artefact ions may comprise: (i) singly charged adduct ions; (ii) doubly charged adduct ions; (iii) triply charged adduct ions; (iv) quadruply charged adduct ions; or (v) adduct ions having five or more charges.

The first adduct or chemical artefact ions may comprise adduct ions having lost or gained a neutral species or molecule.

The method may further comprise determining second and/or further adduct or chemical artefact ions which have mass to charge ratios which have a predetermined relationship with the mass to charge ratio of the parent or precursor ions of interest; and removing or attenuating the second and/or further adduct or chemical artefact ions from the mass spectral data.

The second and/or further adduct or chemical artefact ions may have a non-random mass to charge ratio distribution.

The second and/or further adduct or chemical artefact ions may comprise: (i) singly charged adduct ions; (ii) doubly charged adduct ions; (iii) triply charged adduct ions; (iv) quadruply charged adduct ions; or (v) adduct ions having five or more charges.

The second and/or further adduct or chemical artefact ions may comprise adduct ions having lost or gained a neutral species or molecule.

According to another aspect there is provided a mass spectrometer comprising a control system which is arranged and adapted:

(i) to mass analyse ions and obtain mass spectral data;

(ii) to determine parent or precursor ions of interest;

(iii) to determine first adduct or chemical artefact ions which have mass to charge ratios which have a substantially linear relationship with the mass to charge ratio of the parent or precursor ions of interest; and (iv) to remove or attenuate the first adduct or chemical artefact ions from the mass spectral data.

The substantially linear relationship between the mass to charge ratios of the first adduct or chemical artefact ions and the mass to charge ratio of the parent or precursor ions of interest may comprise a gradient that is related to the charge of the parent or precursor ions and the charges of the first adduct or chemical artefact ions.

The substantially linear relationship between the mass to charge ratios of the first adduct or chemical artefact ions and the mass to charge ratio of the parent or precursor ions of interest may comprise an offset that is related to the mass and charge of the parent or precursor ions.

According to another aspect there is provided a method of mass spectrometry comprising:

mass analysing ions and obtaining mass spectral data;

determining parent or precursor ions of interest;

determining first adduct or chemical artefact ions which have mass to charge ratios which have a predetermined relationship with the mass to charge ratio of the parent or precursor ions of interest; and removing or attenuating the first adduct or chemical artefact ions from the mass spectral data.

According to another aspect there is provided a mass spectrometer comprising a control system which is arranged and adapted:

(i) to mass analyse ions and obtain mass spectral data;

(ii) to determine parent or precursor ions of interest;

(iii) to determine first adduct or chemical artefact ions which have mass to charge ratios which have a predetermined relationship with the mass to charge ratio of the parent or precursor ions of interest; and (iv) to remove or attenuate the first adduct or chemical artefact ions from the mass spectral data.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

According to an embodiment analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to an embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments will now be described, by way of example only, and with reference to the accompanying drawing in which:

FIG. 1B lists the parent or precursor ions and the fragment ions for each of the lines of chemical noise shown in FIG. 1A.

DETAILED DESCRIPTION

Figure 1A:
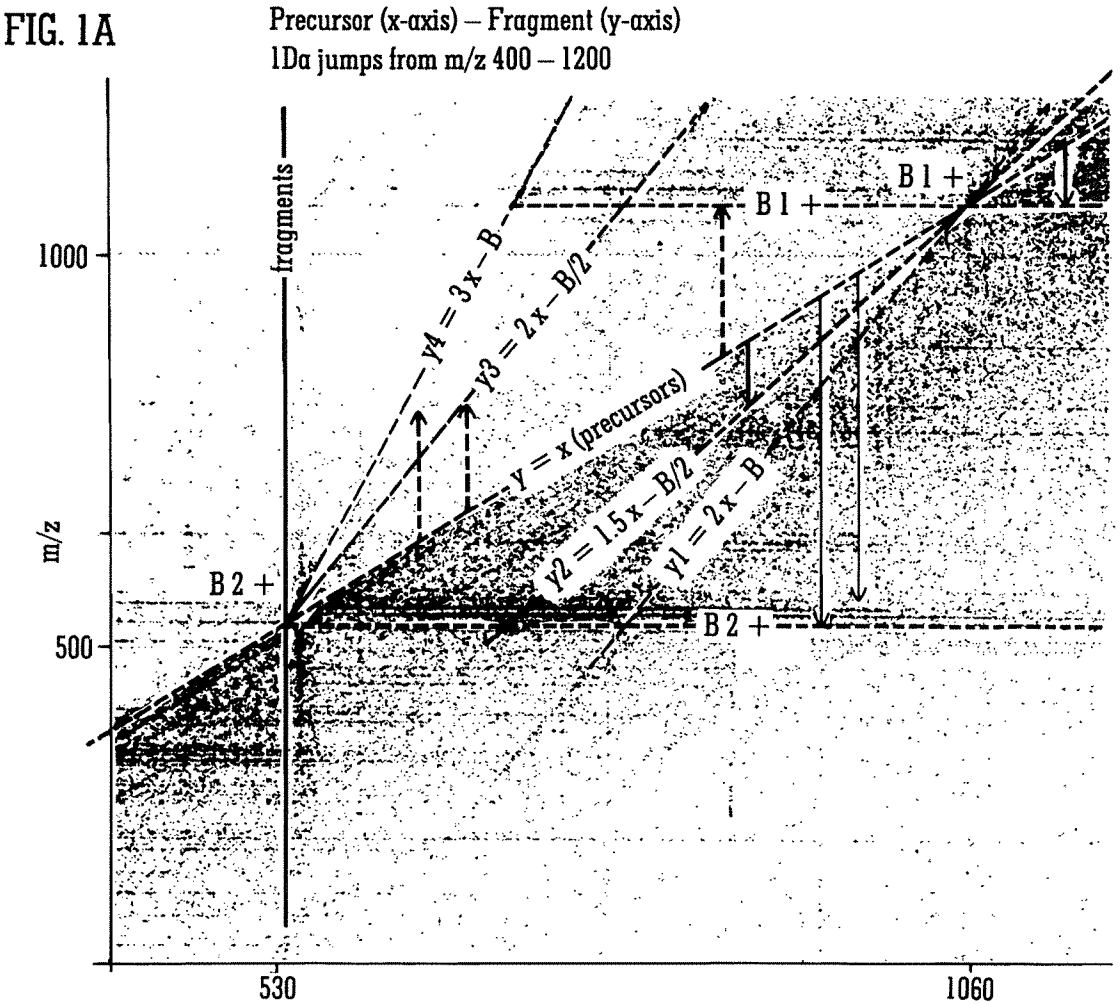
FIG. 1A shows a MS-MS/MS heat map from the peptide bradykinin and illustrates lines of chemical noise which recognised according to an embodiment as relating to adducts ions and subsequently removing the adduct ions from mass spectral data in order to improve the specificity of MS/MS data.

As discussed above, it is known that chemical noise or background ions can inadvertently be counted or treated as analyte data which results in lower scores or even false positive identifications when library searching from both MS or MS/MS data.

It is known that some of the chemical "noise" comprises multiply charged clusters adducted to the analyte peptides themselves.

An embodiment will now be described with reference to FIGS. 1A and 1B.

FIG. 1A shows a MS-MS/MS heat map relating to the peptide bradykinin. The x-axis corresponds to parent or precursor ions selected by a quadrupole mass filter and the y-axis corresponds to the mass to charge ratio of corresponding fragment ions which were generated by fragmenting specific parent or precursor ions selected by the quadrupole mass filter. The resulting fragment ions were then analysed by a Time of Flight mass analyser. The quadrupole mass filter was arranged to jump in 1 Da steps.

The embodiment is concerned with the recognition that various noise lines exist in the mass spectral data shown in FIG. 1A. Furthermore, the embodiment is concerned with the recognition that, for example, noise lines y3 and y4 pass through the point B2+ and correspond with doubly charged bradykinin peptide ions (B2+) having a mass to charge ratio of 531. In a similar manner, noise lines y1 or y2 pass through the point B1+ and correspond with singly charged bradykinin peptide ions (B1+) having a mass to charge ratio of 1060.

An important aspect of the embodiment is the recognition of the presence of substantially linear noise lines and the fact that the noise lines pass either through B1+ or B2+ in the heat map shown in FIG. 1A. According to the embodiment it is recognised that significant sources of chemical noise are not just randomly distributed on the mass to charge ratio scale but are intrinsically related to the sample or the parent or precursor ions of interest.

Apart from the parent or precursor ion diagonal line y=x and the MS/MS data (i.e. fragment ions derived from parent or precursor ions having e.g. a mass to charge ratio of 531 and which are arranged along a vertical line as shown in FIG. 1B) several other significant lines exist and the lines have been empirically annotated as follows.

Noise line "y1" represents singly charged adduct ions after losing singly charged bradykinin. Initially, a doubly charged cluster species was selected by the quadrupole mass filter consisting of an arbitrary variable adduct A1+ and bradykinin B1+ (probably non-covalently bound). This cluster loses bradykinin and its 1+ charge leaving the singly charged adduct ions. These types of adduct ions lie along noise line y1=2x−B.

Noise line "y2" represents the doubly charged adduct ions after losing singly charged bradykinin. Initially, a triply charged cluster species was selected by the quadrupole mass filter consisting of the adduct A2+ and bradykinin B1+. This cluster loses bradykinin and its 1+ charge leaving the doubly charged adduct ions A. These types of adduct ions lie along noise line y2=1.5x−B/2.

Noise line "y3" represents the doubly charged adduct ions after losing doubly charged bradykinin. Initially, a quadruply charged cluster species was selected by the quadrupole mass filter consisting of the adduct A2+ and bradykinin B2+. This cluster loses bradykinin and its 2+ charge leaving the doubly charged adduct ions A. These types of adduct ions lie along noise line y3=2x−B/2.

Noise line "y4" represents the singly charged adduct ions after losing doubly charged bradykinin. Initially, a triply charged cluster species was selected by the quadrupole mass filter consisting of the adduct A1+ and bradykinin B2+. This cluster loses bradykinin and its 2+ charge leaving the singly charged adduct ions A. These types of adduct ions lie along noise line y4=3x−B.

Neutral loss/gain ions to the lines y=B and y=B/2 are also observed.

Other noise lines may also be determined and may similarly be filtered out from the final mass spectral data.

The embodiment may therefore exploit noise patterns in the data which have been identified according to the embodiment in order to enable the removal of ions from mass spectral data which would otherwise distract MS/MS library searches.

In order to further illustrate the embodiment, a Data Dependent Acquisition ("DDA") experiment may be considered wherein several known parent or precursor ions elute at substantially the same time and are identified in a survey scan as parent or precursor ions (corresponding to the molecular weights of) m1, m2, m3, m4 and m5.

If the parent or precursor ion m3 is determined to be of interest then the quadrupole may be set at m3 so as to onwardly transmit just parent or precursor ions having a mass to charge ratio m3 (or a value corresponding to the molecular weight of m3 based on its charge state). The parent or precursor ions having a mass to charge ratio m3 are then subjected to fragmentation in order to obtain MS/MS mass spectral data.

According to the embodiment in order to improve the MS/MS data chemical artefact ions associated with the parent or precursor ions m1,m2,m4,m5 which are not of interest can be calculated (within an appropriate window) using the equations in the table below:

| Precursor m/z: m3 | Noise m/z values: from m1 | Noise m/z values: from m2 | Noise m/z values: from m4 | Noise m/z values: from m5 |
|---|---|---|---|---|
| Noise line y1 | 2*m3-m1 | 2*m3-m2 | 2*m3-m4 | 2*m3-m5 |
| Noise line y2 | 1.5*m3-m1/2 | 1.5*m3-m2/2 | 1.5*m3-m4/2 | 1.5*m3-m5/2 |
| Noise line y3 | 2*m3-m1/2 | 2*m3-m2/2 | 2*m3-m4/2 | 2*m3-m5/2 |
| Noise line y4 | 3*m3-m1 | 3*m3-m2 | 3*m3-m4 | 3*m3-m5 |
| Neutral loss/gain | m1/2 | m2/2 | m4/2 | m5/2 |
| Neutral loss/gain | m1 | m2 | m4 | m5 |

It can be seen from the table that the noise lines show a substantially linear relationship with the mass to charge ratio (or a value corresponding to the molecular weight) of the parent or precursor ions m1, m2, m3, m4 and m5.

In the example, the values of the gradient of the noise lines include 0, 1, 1.5, 2, 3. The gradient of the noise lines is found to be dependent on the charges of the parent or precursor ions, the charges of adduct and the charges that are lost when the parent or precursor ions are lost.

In the example, the offset of the noise lines is determined by the molecular weight of the parent and precursor ions and their charges, for example, the offset of the noise lines for the noise from m1 is a value derived from m1.

The chemical artefact ions once calculated or otherwise determined as detailed above may then be removed from the mass spectral data.

Although the technology described herein has been described with reference to one or more embodiments, it will be understood by those skilled in the art that various changes in form and detail may be made without departing from the scope of the invention as set forth in the accompanying claims.

The invention claimed is:

1. A method of mass spectrometry comprising:

mass analysing ions and obtaining mass spectral data;

determining multiply charged parent or precursor ions of interest;

determining first adduct or chemical artefact ions which have mass to charge ratios which have a substantially linear relationship with the mass to charge ratio of said multiply charged parent or precursor ions of interest based on the substantially linear relationship between the mass to charge ratios of the adduct or chemical artefact ions and the mass to charge ratio of the multiply charged parent or precursor ions of interest; and removing or attenuating said first adduct or chemical artefact ions from said mass spectral data.

2. A method as claimed in claim 1, further comprising progressively scanning a mass to charge ratio transmission window of a mass filter.

3. A method as claimed in claim 2, wherein said mass filter comprises a quadrupole rod set mass filter.

4. A method as claimed in claim 2, further comprising causing said mass filter to preferentially onwardly transmit said multiply charged parent or precursor ions of interest and to attenuate or filter other parent or precursor ions.

5. A method as claimed in claim 4, further comprising subjecting said multiply charged parent or precursor ions of interest to fragmentation or reaction so as to generate fragment or product ions.

6. A method as claimed in claim 1, wherein said first adduct or chemical artefact ions have a non-random mass to charge ratio distribution.

7. A method as claimed in claim 1, wherein said first adduct or chemical artefact ions comprise: (i) singly charged adduct ions; (ii) doubly charged adduct ions; (iii) triply charged adduct ions; (iv) quadruply charged adduct ions; or (v) adduct ions having five or more charges.

8. A method as claimed in claim 1, wherein said first adduct or chemical artefact ions comprise adduct ions having lost or gained a neutral species or molecule.

9. A method as claimed in claim 1, further comprising:

determining second or further adduct or chemical artefact ions which have mass to charge ratios which have a substantially linear relationship with the mass to charge ratio of said multiply charged parent or precursor ions of interest; and removing or attenuating said second or further adduct or chemical artefact ions from said mass spectral data.

10. A method as claimed in claim 9, wherein said second or further adduct or chemical artefact ions have a non-random mass to charge ratio distribution.

11. A method as claimed in claim 9, wherein said second or further adduct or chemical artefact ions comprise: (i) singly charged adduct ions; (ii) doubly charged adduct ions; (iii) triply charged adduct ions; (iv) quadruply charged adduct ions; or (v) adduct ions having five or more charges.

12. A method as claimed in claim 9, wherein said second or further adduct or chemical artefact ions comprise adduct ions having lost or gained a neutral species or molecule.

13. A method as claimed in claim 1, wherein the substantially linear relationship between the mass to charge ratios of said first adduct or chemical artefact ions and the mass to charge ratio of said multiply charged parent or precursor ions of interest comprises a gradient that is related to the charge of said multiply charged parent or precursor ions of interest and the charges of said first adduct or chemical artefact ions.

14. A method as claimed in claim 1, wherein the substantially linear relationship between the mass to charge ratios of said first adduct or chemical artefact ions and the mass to charge ratio of said multiply charged parent or precursor ions of interest comprises an offset that is related to the mass of parent or precursor ions not of interest.

15. A mass spectrometer comprising a control system which is arranged and adapted:

(i) to mass analyse ions and obtain mass spectral data;

(ii) to determine multiply charged parent or precursor ions of interest;

(iii) to determine first adduct or chemical artefact ions which have mass to charge ratios which have a substantially linear relationship with the mass to charge ratio of said multiply charged parent or precursor ions of interest based on the substantially linear relationship between the mass to charge ratios of the adduct or chemical artefact ions and the mass to charge ratio of the multiply charged parent or precursor ions of interest; and (iv) to remove or attenuate said first adduct or chemical artefact ions from said mass spectral data.

16. A method of mass spectrometry comprising:

generating fragment ions by fragmenting parent or precursor ions;

mass analysing said fragment ions and obtaining mass spectral data;

determining parent or precursor ions of interest;

determining first adduct or chemical artefact ions which have fragment mass to charge ratios which have a substantially linear relationship with a mass to charge ratio of said parent or precursor ions of interest based on the substantially linear relationship between the fragment mass to charge ratios of the adduct or chemical artefact ions and the mass to charge ratio of the parent or precursor ions of interest; and removing or attenuating said first adduct or chemical artefact ions from said mass spectral data; and wherein said parent or precursor ions of interest comprise multiply charged parent or precursor ions of interest.

17. A mass spectrometer comprising a control system which is arranged and adapted:

(i) to generate fragment ions by fragmenting parent or precursor ions;

(ii) to mass analyse said fragment ions and obtain mass spectral data;

(iii) to determine parent or precursor ions of interest;

(iv) to determine first adduct or chemical artefact ions which have fragment mass to charge ratios which have a substantially linear relationship with the mass to charge ratio of said parent or precursor ions of interest based on the substantially linear relationship between the fragment mass to charge ratios of the adduct or chemical artefact ions and the mass to charge ratio of the parent or precursor ions of interest; and (v) to remove or attenuate said first adduct or chemical artefact ions from said mass spectral data; and wherein said parent or precursor ions of interest comprise multiply charged parent or precursor ions of interest.

* * * * *